United States Patent [19]

Cook et al.

[11] 3,930,962

[45] Jan. 6, 1976

[54] PROCESS AND APPARATUS FOR PRODUCING THIN COPPER FOILS ON A MOLYBDENUM OR TZM ALLOY DRUM

[75] Inventors: Glenn M. Cook, Harvard, Mass.; Walter E. Galin, Pawtucket, R.I.

[73] Assignee: Kennecott Copper Corporation, New York, N.Y.

[22] Filed: Feb. 21, 1975

[21] Appl. No.: 551,767

[52] U.S. Cl. ..... 204/13; 204/281

[51] Int. Cl.[2] ..... C25D 1/04

[58] Field of Search ..... 204/3, 13, 281

[56] References Cited

UNITED STATES PATENTS

| | | | |
|---|---|---|---|
| 3,461,046 | 8/1969 | Clancy | 204/13 |
| 3,677,906 | 7/1972 | Wang | 204/13 |

*Primary Examiner*—T. M. Tufariello

*Attorney, Agent, or Firm*—John L. Sniado; Lowell H. McCarter; John A. Lahive, Jr.

[57] ABSTRACT

A process and apparatus for producing thin copper foils by electroplating the copper onto a rotating drum serving as a cathode where the surface of the rotating drum is molybdenum or TZM alloy.

7 Claims, 1 Drawing Figure

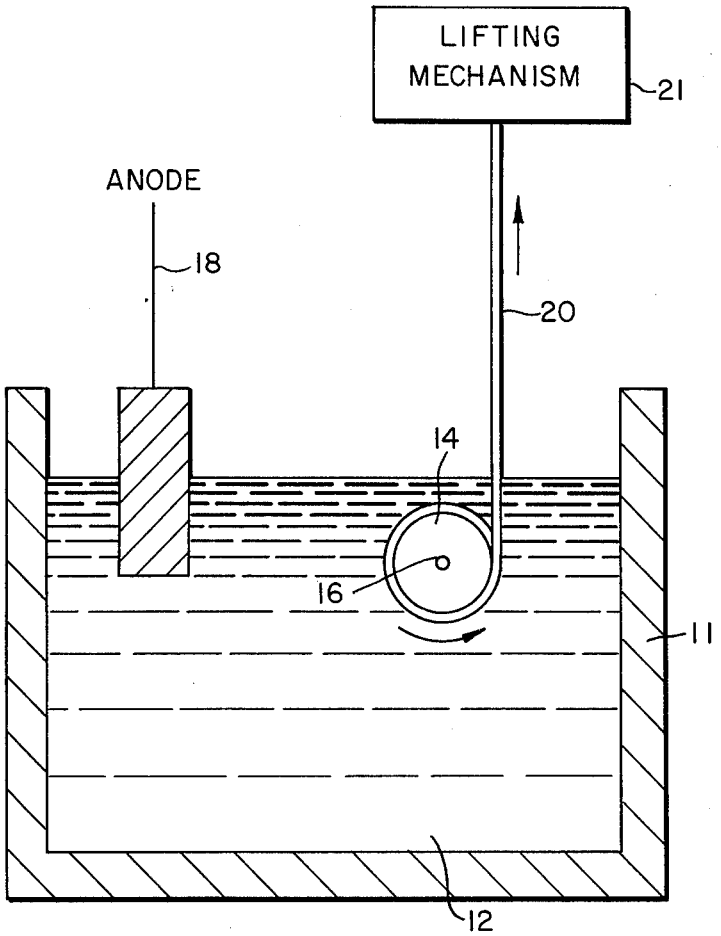
LIFTING
MECHANISM
21
ANODE
18
20
14
16
11
12

PROCESS AND APPARATUS FOR PRODUCING THIN COPPER FOILS ON A MOLYBDENUM OR TZM ALLOY DRUM

FIELD OF THE INVENTION

This invention relates in general to a method and apparatus for manufacturing copper foils and more particularly to an economical electrolytic process using a rotating cathode drum to produce pinhole free, ultra-thin copper foils.

BACKGROUND OF THE INVENTION

Thin copper foils, having a thickness of 0.003 inches or less, free of pinholes, and having a purity of greater than 99 percent are required for printed circuit applications. In addition to meet military specifications many of these foils are required to maintain a surface characteristic of 0.17 micro inches. Foils for this purpose are generally produced in an electrolytic process in which copper from a copper anode or copper containing electrolyte is plated into a rotating drum serving as a cathode and the foil is peeled off the drum as it rotates. In the production of such foils various drum materials have been employed in the prior art. These include stainless steel, chromium, titanium and rhenium. It has proven very difficult to produce pinhole free foils at small thicknesses employing the stainless steel, chromium or titanium drums. As described in U.S. Pat. No. 3,677,906, substantially pinhole free thin foil has been successfully produced utilizing a drum having a rhenium surface. There remain, however, some problems associated with even the rhenium surface drum. One such problem is the deterioration of the drum surface with time and the roughened drum surface results in a roughened foil surface. A second problem is the relatively high expense associated with the preparation and maintenance of the rhenium drum.

SUMMARY OF THE INVENTION

Broadly speaking, in the present invention substantially pinhole free copper foils in a thickness range from 0.5 to 2.55 mils have been produced using as a cathode a rotating drum having, in one example, a molybdenum surface and, in a second example a titanium, zirconium, molybdenum alloy surface. The anode was formed of copper and an electrolytic solution of copper sulfate, sulfuric acid and water was employed.

DESCRIPTION OF THE DRAWINGS

The single FIGURE is a schematic representative of an electrolytic plating apparatus suitable for use in the practice of this invention.

DESCRIPTION OF PREFERRED EMBODIMENTS

With reference now to the drawing, an electrolytic tank 11 contains an electrolytic solution 12 in which is inserted an anode 18 and a cathode 16, the latter consisting of a rotating drum 14 from which electrolytically plated copper foil 20 is peeled by means of a lifting mechanism 21. The drum 14 is kept rotating at a relatively slow speed in a counterclockwise direction by means of a motor (not shown). It will be understood that the apparatus illustrated is schematic in form and that the actual physical apparatus may take any of several conventional forms well known in the art. One suitable form employs an anode 18 formed of dynel bagged cathode grade copper with an electrolytic solution formed of 240 grams $CuSO_4.5H_2O$, 60 grams $H_2SO_4$ and 1 liter of $H_2O$. The cell was operated at room temperature with a current from 1.1 to 2.4 amps and a voltage which varied between 1.86 to 5.12 volts. The plating drum 14 was formed of molybdenum with an active plating area of 2 11/16 inches in length with a 0.62 inch diameter and a separation between the cathode 14 and the anode 18 of 7 inches. A filtering pump (not shown), recirculated the electrolytic solution 6 to 12 times per hour.

Another suitable drum surface consists of a molybdenum-based alloy containing, for example, up to about 0.20 to about 1.0% titanium and up to about 0.04 to about 0.25% zirconium. This alloy is referred to herein as TZM alloy.

While an electrolytic solution of copper as above described is preferred, any of the known electrolytic copper solutions may be used. For example fluoborate electrolyte may be used. The fluoborate electrolyte consists of cupric fluoborate, fluoboric acid and boric acid. A preferred fluoborate electrolyte will contain about 2.05 M cupric fluoborate, 0.44 M fluoborate acid and 1.05 M boric acid in distilled water.

Tankhouse electrolytes as are commonly used in the electro-refining of copper may also be used. These tankhouse electrolytes may consist of cupric sulfate, sulfuric acid, one or more additional agents(s) such as glue, calcium ligno sulfonate, casein, thiourea and the usual impurities found in tankhouse electrolytes. A comprehensive discussion of typical tankhouse electrolytes may be found in the *Encyclopedia of Technology*, 2nd Edition, 1965, Vol. 6, pps. 157–163.

The preparation of the drum surface is described below. However any other method whereby the surface can be prepared to provide a 1 micron finish can be used in preparing the surface. In the experimental work described herein, the drum surface was in rod form. A TZM alloy rod was wetted with odorless kerosene and polished consecutively with a series of about 6 abrasive papers starting with grit no. 220 and ending with 4/0. Upon completion of each polishing step, the rod surface was wiped with a paper towel to remove the residual grit. After polishing with abrasive paper 4/0 grit, the rod was degreased in trichlorethylene, washed with tincture of green soap and rinsed with deionized water. To provide the 1 micron finish surface, the rod was once again wetted with odorless kerosene and polished consecutively with a series of diamond containing paste materials, i.e., containing diamond particles of 9, 6, 3 and 1 micron size. Prior to deposition of the copper foil, the rod was degreased in trichlorethelene, washed with tincture of green soap and rinsed in deionized water. The rod was inspected under a microscope in order to ensure that the rod was free of finger smudges, foreign particles and irregular scratches.

EXAMPLE 1

In each of the following examples the copper sulfate electrolyte used consisted of 240 grams $CuSO_4.5H_2O$, 60 grams $H_2SO_4$ and 1 liter of water. The plating surface was a molybdenum base alloy, i.e., TZM alloy, containing approximately 0.5% titanium and 0.08% zirconium. The drum surface had an active plating area of 2 – 1 1/16 inch long with 0.62 inch diameter and a separation between the cathode and the anode of approximately 7 inches. A filtering pump on the electrolyte bath recirculated the electrolyte solution between 6 to 12 times per hour.

| | |
|---|---|
| Cell Voltage | 3.8 volts |
| Total Current | 1.4 Amperes |
| Foil Thickness | 0.001" (1 mil) |
| Length of Foil Produced | 27' |
| No. of plating/strip cycles (no. of rotations of drum) | 1,100 |

EXAMPLE 2

Following the procedure as described in Example 1, the following was obtained:

| | |
|---|---|
| Cell Voltage | 2.2 volts |
| Total Current | 1.0 amperes |
| Foil Thickness | 0.0005"–0.0006" (Approx. ½ mil) |
| Length of Foil Produced | 21' |
| No. of plating/strip cycles (no. of rotations of drum) | 860. |

EXAMPLE 3

Following the procedure described in Example 1, the following was obtained:

| | |
|---|---|
| Cell Voltage | 5.1 volts |
| Total Current | 2.4 amperes |
| Foil Thickness | 0.0018"–0.002" (1.8–2 mil) |
| Length of Foil Produced | 2' |
| No. of plate/strip cycles (no. of rotations of drum) | 80 |

EXAMPLE 4

A molybdenum plate and a 304 stainless steel plate was used to plate thin foil using the electrolyte as described in Example 1. A variable current density cell (Hull) was used.

| | |
|---|---|
| Total Current | 1.5 amperes |
| Plated Area | 6 sq. inch |
| Plating Time | 7.5 min. |
| Foil Thickness | about 0.05 mil to 1.0 mil |

On the 304 stainless steel plating surface satisfactory foil failed to deposit out at the low current density end of a plate. On the molybdenum plating surface, a variable thickness foil was produced ranging from about the 0.05 to about 1.0 mil thickness and exhibited only minor pinholing effect.

EXAMPLE 5

Using the conditions of Example 4, a series of clean plating surfaces were used. These surfaces included: molybdenum, 304 stainless steel, rhenium, and chromium. The foil deposited on the molybdenum, stainless steel, and rhenium surfaces was accomplished at a total current of 1.5 amperes for a period of 7 ½ minutes. On the chromium surface, the foil was deposited at 0.9 amperes for 13 minutes. The results are shown in the Table below:

TABLE

| | FOIL CONDITION | | |
|---|---|---|---|
| Plating Surface | Foil Thickness Pinhole free | Foil Thickness Minor pinholes | Foil Thickness Major pinholes |
| Molybdenum | 0.24 mil | .08–0.2 mil | less than 0.08 mil |
| 304 Stainless steel | 0.28 mil | 0.13–0.28 | less than 0.13 mil |
| Rhenium | 0.21 mil | 0.13–0.21 | less than 0.13 mil |
| Chromium | 0.45 mil | less than 0.45 mil | less than 0.45 mil |

This example shows the effect of foil thickness with regard to the substrate on pinholing and shows that a molybdenum surface may be used to provide very thin foil thicknesses with only minor pinholing effect.

It has been noted that the molybdenum drum will corrode and thus exhibit a roughened surface upon exposure to air. However, this effect tends to be self-healing with continued use and unlike other drum surface material, there appears to be very little, if any, deterioration of the molybdenum or titanium, zirconium, molybdenum alloy surface with prolonged use of the plating apparatus. While the drum is preferably completely immersed in the electrolytic solution, there are situations where the drum becomes only partly immersed. Under these conditions, the exposure of a rhenium drum has resulted in deterioration of its surface with a resultant decrease in the produced foil. Since the molybdenum drum does not undergo such deterioration with only partial immersion, this represents a considerable advantage. We claim:

1. In a process for preparing thin copper foils, the improvement comprising, electrodepositing the copper on a rotating electrode having a molybdenum surface.

2. In a process for preparing thin copper foils, the improvement comprising electrodepositing the copper on a rotating electrode having a surface formed from a titanium, zirconium, molybdenum alloy.

3. A process in accordance with claim 1 wherein the copper is plated from a soluble anode in a plating solution of proportions 240 grams $CuSO_4.5H_2O$, 60 grams $H_2SO_4$ and 1 liter of $H_2O$.

4. A process in accordance with claim 1 wherein the copper is plated from a soluble anode in a plating solution consisting of cupric fluorobate, fluoboric acid and boric acid in distilled water.

5. A process in accordance with claim 4 wherein the plating solution proportions are: 2.05 M cupric fluoborate, 0.44 M fluoborate acid and 1.05 M boric acid in distilled water.

6. Apparatus for the electrolytic production of copper foil comprising, an electrolyte tank, a copper anode having at least a portion of its surface within said electrolyte tank, a rotatable drum having a portion of its surface disposed within said tank, said rotatable drum having a molybdenum surface and means to rotate said drum.

7. Apparatus in accordance with claim 6 wherein said rotatable drum has a surface formed of titanium, zirconium, molybdenum alloy.

* * * * *